United States Patent [19]

Deutsch

[11] Patent Number: 4,683,793

[45] Date of Patent: Aug. 4, 1987

[54] DATA REDUCTION FOR A MUSICAL INSTRUMENT USING STORED WAVEFORMS

[75] Inventor: Ralph Deutsch, Sherman Oaks, Calif.

[73] Assignee: Kawai Musical Instrument Mfg. Co., Ltd., Hamamatsu, Japan

[21] Appl. No.: 827,983

[22] Filed: Feb. 10, 1986

[51] Int. Cl.[4] ..... G10H 7/00

[52] U.S. Cl. ..... 84/1.01; 84/1.23; 84/1.28

[58] Field of Search ..... 84/1.01, 1.03, 1.19–1.23, 84/1.28

[56] References Cited

U.S. PATENT DOCUMENTS 3,763,364 10/1973 Deutsch et al. ..... 84/1.03 X
4,249,448 2/1981 Deutsch et al. ..... 84/1.23
4,442,745 4/1984 Gross et al. ..... 84/1.01
4,520,708 6/1985 Wachi ..... 84/1.01 X
4,584,921 4/1986 Wachi ..... 84/1.01

*Primary Examiner*—Stanley J. Witkowski
*Attorney, Agent, or Firm*—Ralph Deutsch

[57] ABSTRACT

A keyboard operated musical instrument is disclosed in which the musical tones are generated by reading out data values stored in a waveshape memory. The number of stored data points is reduced by storing the data values in segments corresponding to one-half of the number of data points for a period of a waveshape. By using synthesized data having a symmetry about the midpoint the second half of the waveshape is recovered by a forward and backward memory address read of each waveshape segment. After reading each segment a predetermined number of cycles, an abrupt jump is made to the next segment of waveshape data points.

10 Claims, 4 Drawing Figures

DATA REDUCTION FOR A MUSICAL INSTRUMENT USING STORED WAVEFORMS

BACKGROUND OF THE INVENTION

1. Field of the Invention

This invention relates to musical tone synthesis and in particular is concerned with an improvement for producing tones from stored musical waveshapes.

2. Description of the Prior Art

A wide variety of musical tone generation systems have been designed which attempt to realistically replicate the sounds produced by conventional acoustic musical instruments. In general these systems have produced only poor imitative sounds because they lack the capability to produce the complex time variations of the musical waveform that characterizes a tone from a particular acoustic musical instrument.

The most obvious method to imitate a musical instrument is to record the sound and to replay these recordings in response to an actuated keyswitch. While at first thought the straightforward technique or recording and keyed playback seems to be attractive, a practical realization of such a musical instrument can be burdened by a large amount of memory required to store the recorded data. The maximum amount of storage is associated with a system that uses a separate and distinct recording for each note played in the range of the musical instrument's keyboard. Some economy in the storage requirement has been made by using a single recording for several contiguous musical notes. This assumes that the waveshape for the imitated musical instrument does not change greatly between several successive notes.

Electronic musical tone generators that operate by playing back recorded musical waveshapes stored in a binary digital data format have been given the generic name of PCM (Pulse Code Modulation). This is an unfortunate label because PCM can mean almost anything. In particular PCM in no way simply identifies the tone generator as one in which a recorded tone is simply stored in a binary digital data format. A musical instrument of the PCM type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

A method of reducing the amount of stored data in a simple PCM musical tone generator is described in U.S. Pat. No. 3,763,364 entitled "Apparatus For Storing And Reading Out Periodic Waveforms." The disclosed system utilizes the even and/or odd symmetry of a waveform in such a manner that only sample points for one-half of the waveform need be stored in a waveshape memory. When the waveform is read from the waveshape memory, the unstored sample points of the second half of the waveform are recreated by using the symmetry property of the stored data points.

SUMMARY OF THE INVENTION

In a musical tone generator of the type in which the musical tone is generated by reading out stored waveshape points a reduction in the number of stored waveshape points is obtained without eliminating the temporal variations of the tonal spectrum. Each waveshape memory stores a number of segments of data points. Each segment corresponds to one-half the period of a synthesized waveshape having a waveshape symmetry about a half-wave point and having a spectra equal to that of a corresponding segment of a musical tone recorded from a musical instrument.

The missing waveshape points are reconstructed by reading out each segment in a forward and reverse memory order and then jumping to an adjacent segment where the forward and back read operation is repeated.

A further reduction in the amount of stored data is obtained by repeating the data read for a given segment of waveshape memory a predetermined number of cycles before a jump is made to an adjacent segment.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a musical tone generator of the type in which a musical waveshape is stored in a memory. The generated tones are created in response to actuation of the instrument's by reading out the stored waveshape data repetitively in a particular prescribed sequence.

Figure 4:
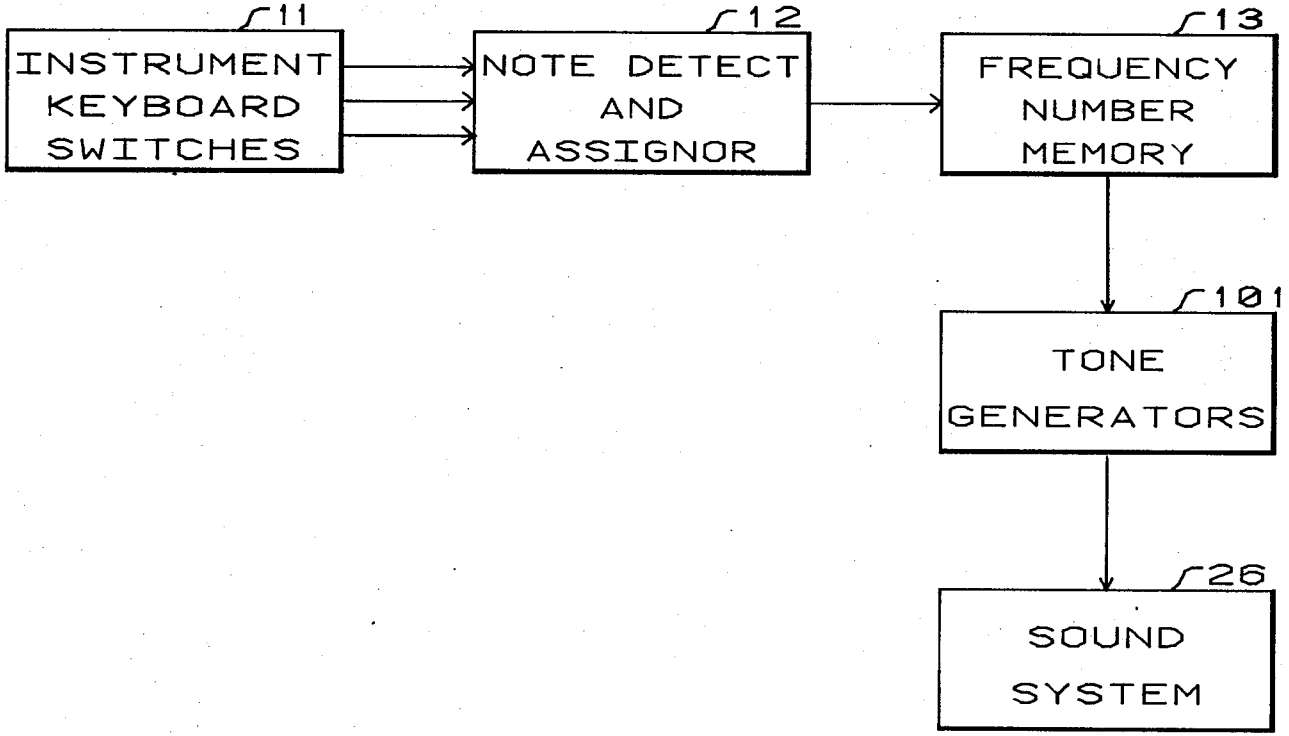
FIG. 4 is a schematic diagram of an embodiment of the invention.

FIG. 4 shows an embodiment of the present invention as incorporated into a keyboard operated electronic musical tone generator. The keyboard switches are contained in the system block labeled instrument keyboard switches 11. If one or more of the keyboard switches has a switch status change and is actuated ("on" switch position), the note detect and assignor 12 encodes the detected keyboard switch having the status change to an actuated state and stores the corresponding note information in a memory which is contained in the note detect and assignor 12. A tone generator is assigned to each actuated keyswitch using the encoded detection generated by and stored in the note detect and assignor 12.

A suitable configuration for a note detect and assignor subsystem is described in U.S. Pat. No. 4,022,098 entitled "Keyboard Switch Detect And Assignor." This patent is hereby incorporated by reference.

When the note detect and assignor 12 finds that a keyboard switch has been actuated, a frequency number corresponding to the actuated switch is read from the frequency number memory 13. The frequency number memory 13 can be implemented as a read-only addressable memory (ROM) containing data words stored in binary numeric format having values $2^{(N-M)/12}$ where N has the range of values N=1,2, . . . ,M and M is equal to the number of keyswitches on the musical instrument's keyboard. N designates the number of keyboard switches. These switches are numbered consecutively from "1" at the lowest keyboard switch. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

Figure 1:
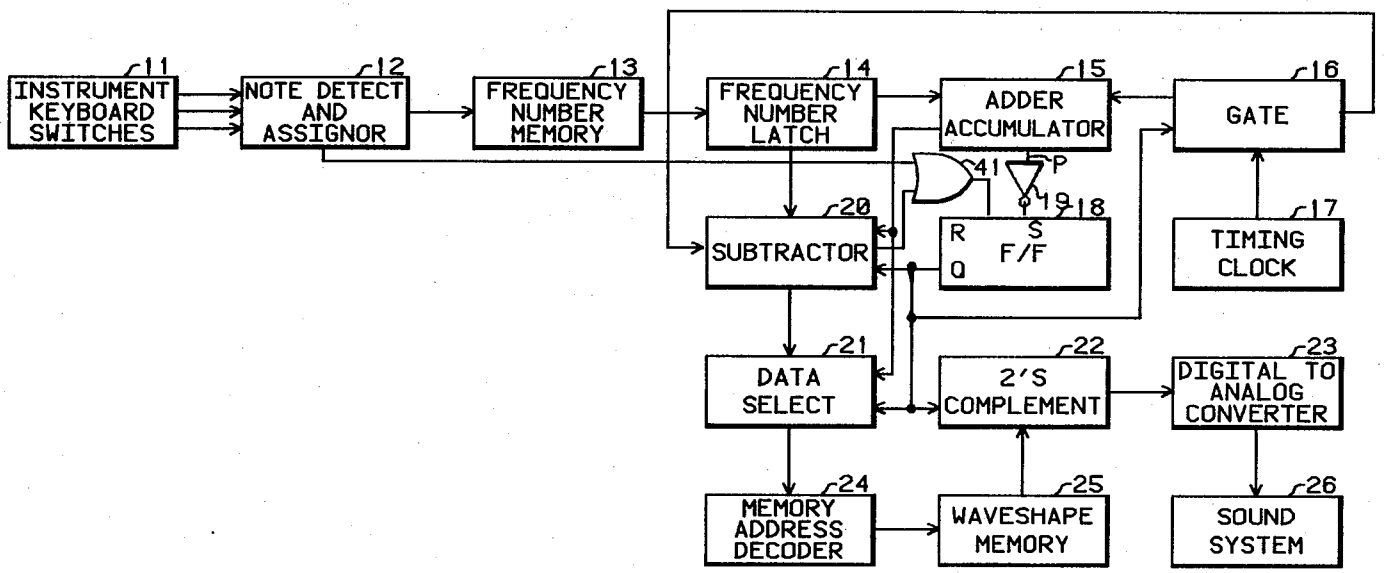
FIG. 1 is a schematic diagram of an embodiment of the invention showing the details of one of the tone generators.

FIG. 1 illustrates an embodiment of the invention showing details of one of the tone generators contained in the box of FIG. 4 labeled note generators 101.

The frequency number read out of the frequency number memory 13 is stored in the frequency number latch 14. In response to timing signals produced by the timing clock 16, the frequency number contained in the frequency number latch 14 is successively added to the content of the accumulator contained in the adder-accumulator 15. The content of the accumulator is the accumulated sum of a frequency number.

At the same time that the tone generator is assigned, the note detect and assignor 12 sends a signal via OR-gate 41 which resets the flip-flop 18 so that its output logic state is Q=0. In response to the state Q=0, the data select 21 selects and transmits the accumulated frequency number contained in the adder-accumulator 15 to the memory address decoder 24. The data selected by the data select 21 is used by the memory address decoder 24 to read out waveshape data points stored in the waveshape memory 25.

In the manner described below, the waveshape memory 25 contains segments of half-period waveshapes which have been computed to have an odd symmetry about the midpoint of a period. If the state of the flip-flop 18 is Q=0, then the 2's complement 22 will transfer the data read out of the waveshape memory unaltered to the digital-to-analog converter 23. If Q=1, then the 2's complement 22 will perform a 2's complement numerical operation on its input data before it is sent to the digital-to-analog converter 23.

The output data from the 2's complement 22 is converted into an analog signal by means of the digital-to-analog converter 23. The resultant signal is transformed into an audible musical tone by means of the sound system 26 which consists of a conventional amplifier and speaker combination.

For the preferred embodiment of the invention the number of data points in segment of a half-period waveshape stored in the waveshape memory 25 is B/2 and B/2 is numerically equal to a power of 2. A good choice for most tone generation systems is B/2=32 which will correspond to a waveshape having a maximum of 32 harmonics.

The selection of B/2 equal to a power of two is not a restriction or limitation of the invention. It is a simple matter, in view of the following description, to use any other integer value of B/2.

The frequency number R stored in the frequency number latch corresponds to a decimal number having a value which is nominally less than or equal to one. The accumulated frequency number contained in the accumulator of the adder-accumulator 15 can be considered to consist of an integer portion and a decimal portion. It is the integer portion of the accumulated frequency number that is transferred to the data select 21. For the decimal number equivalent of the accumulated frequency number the radix point corresponds to the decimal point.

The output P from the adder-accumulator 15 is the value of the seventh bit to the left of the radix point of the accumulated frequency number. The generation of the P signal is called the first state detect means. In response to the binary logic state P=0, the inverter 19 causes the flip-flop 18 to be set so that its output binary logic state is Q=1. Q=1 is called the first state change signal.

While Q=1, the gate 16 inhibits the transfer of timing signals from the timing clock 17 to the adder-accumulator 15. Thus during the state Q=1, the value of the accumulated frequency number in the adder-accumulator 15 is maintained constant at its current value.

In response to the state change from Q=0 to Q=1, the accumulated frequency number in the adder-accumulator 15 is transferred to a data storage latch contained in the system block labeled subtractor 20. In response to Q=1, the timing signals produced by the timing clock 17 are transferred by gate 16 to the subtractor 20. In response to these timing signals the frequency number stored in the frequency number latch 14 is repetitively subtracted from the accumulated frequency number stored in the data storage latch contained in the subtractor 20. The result is called a modified accumulated frequency number.

If Q=1, the data select 21 transfers the integer portion of the accumulated frequency number in the data storage latch of the subtractor 20 to the memory address decoder 24.

When the first six bits to the left of the radix sign of the accumulated frequency number in the data storage latch of the subtractor 20 all have a zero value, a signal is generated, by a second state detect means, which is transmitted via the OR-gate 41 to reset the flip-flop 18. This places the output state of the flip-flop 18 to Q=0. Q=0 corresponds to a second state change signal.

The net result of the system logic described above is that a segment of the waveshape memory 25 of B/2 points is first read out in increasing memory order and then the same segment is read out in reverse memory order. When the reverse order is completed an abrupt jump is made to the next contiguous segment of B/2 data points. Since, as detailed below, the stored waveshape data points for each segment are computed with an odd symmetry about the half-period point, the forward and reverse reading of the stored B/2 data points in cooperation with action of the 2's complement 22 recovers the missing waveshape data points and thereby only ½ of the number of waveshape data points have to be stored in the waveshape memory 25.

An alternative arrangement is to calculate the waveshape segments stored in the waveshape memory 25 to have an even symmetry about the half-period point. If an even symmetry is used then the 2's complement 22 is removed from the system and the data points read out from the waveshape memory 25 are transmitted directly to the digital-to-analog converter 23.

The data points stored in the waveshape memory 25 can be produced by the following procedural method. A recording is made of a musical sound such as that produced by a selected acoustic musical instrument. The recording is made by passing the signal from the microphone through a filter such that all overtones above the 32nd harmonic are substantially attenuated.

This number of harmonic corresponds to the choice of $B/2=32$ data points for each segment of the data stored in the waveshape memory 25.

Either an analog or digital recorder can be used to record the data. If an analog recorder is used then the digital-to-analog transformation required for the data analysis can be performed on the output of the recorded tape.

The nominal period $P_0$ of the recorded musical tone as measured in the number of consecutive recorded ditital samples is measured by performing a Fourier transform of a subset of data points which follow the initial attack transient at the start of the tone.

For each segment of the recorded digital data of size $P_0$, a Fourier analysis is performed to determine the numerical values of the harmonic coefficients for harmonics that are less than or equal to a preselected maximum harmonic number $H=32$.

A new waveshape is synthesized using the measured set of harmonic coefficients. The Fourier synthesis can be computed such that the resultant waveshape has either an odd symmetry or an even symmetry about the waveshape midpoint.

For the preferred embodiment in which $B/2=32$, the maximum number of harmonics is $G=B/2=32$. One half of the synthesized waveform is stored in a segment of the waveshape memory 25 corresponding to the analyzed segment.

The computational process of segment data analysis and waveshape synthesis is continued for the entire set of recorded data samples. The net result is a reduction in the number of data points stored in the waveshape memory in comparison to the number of recorded data points.

The use of a Fourier series waveshape synthesis to produce symmetrical waveshapes is disclosed in U.S. Pat. No. 3,763,364 entitled "Apparatus For Storing And Reading Out Periodic Waveforms." This patent is hereby incorporated by reference.

Only a representative one of a plurality of tone generators, contained in the system block labeled tone generators 101 in FIG. 4, is shown in FIG. 1. The representative tone generator is comprised of the system blocks 11,12,13, and 26. These blocks can be replicated for the other tone generators to provide for a polyphonic tone generator.

Figure 2:
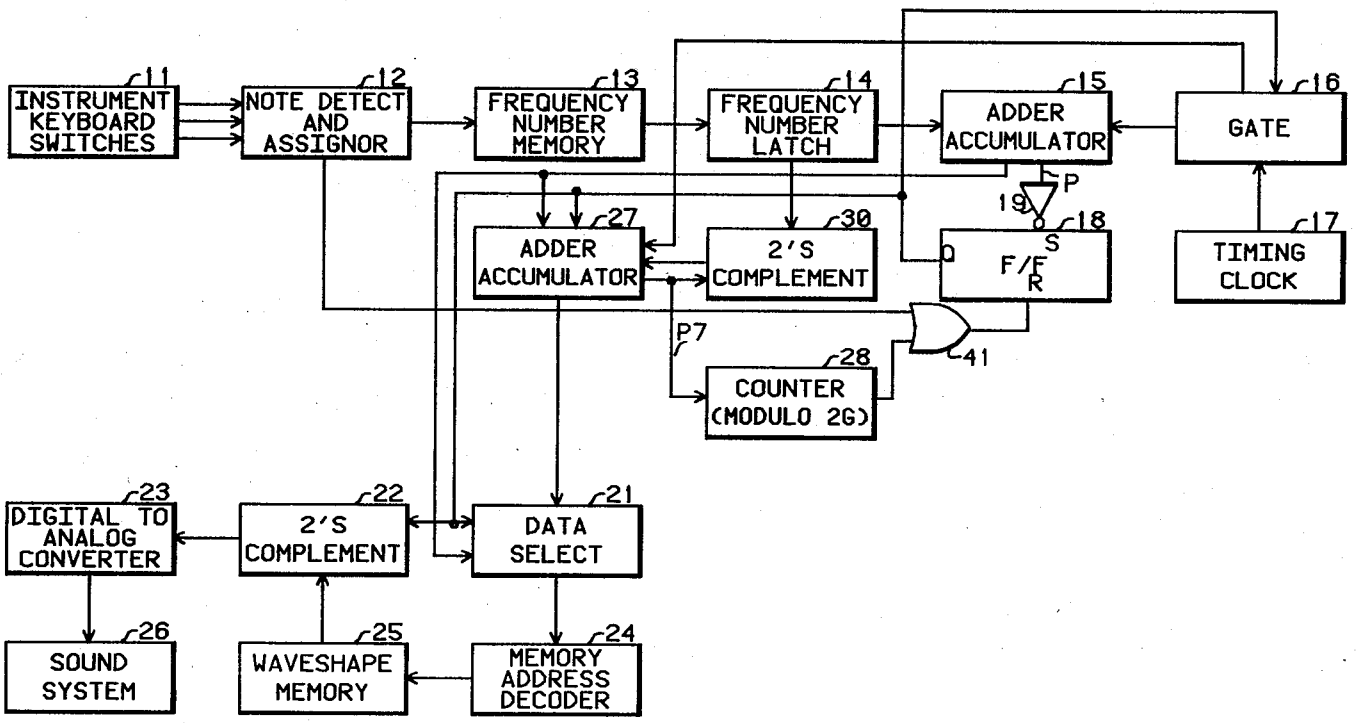
FIG. 2 is a schematic diagram of an alternative embodiment of the invention.

FIG. 2 shows an alternative embodiment of the present invention. The improvement provided by this configuration is a further reduction in the number of data points that are stored in the waveshape memory 25. The further reduction in the amount of data storage is accomplished by generating a tone in which successive periods of waveshape segments do not change for each period. Thus a given selected segment is repeated several times before proceeding to the next segment of the waveform.

In the system configuration shown in FIG. 2 each stored segment of the waveform is repeated G times in a forward and back memory read before a jump is made to the next segment. Each segment of a symmetric waveshape having B/2 points are computed by the data analysis and synthesis process previously described.

As previously described for the common system configuration elements shown in FIG. 1, when $P=0$ the inverter 19 causes the flip-flop 18 to be set so that its output binary logic state is $Q=1$. In response to the change of state $Q=0$ to $Q=1$, the accumulated frequency number contained in the adder-accumulator 15 is copied into the accumulator contained in the adder-accumulator 27.

While the state of the flip-flop 18 is $Q=1$, the adder-accumulator 27 receives timing pulses from the timing clock 17 which are transmitted by the gate 16. In response to the timing pulses, the adder-accumulator 27 repetitively adds the frequency number stored in the frequency number latch 14 to the contents of the accumulator contained in the adder-accumulator 27.

Each time that the seventh bit $P_7$ to the left of the radix point for the value contained in the accumulator changes its state a signal is generated which is used to increment the counter 28. Counter 28 is implemented to count modulo 2G, where G is the number of times each segment of the waveshape stored in the waveshape memory is repeated.

If $P_7$ is a "1" then the 2's complement 30 will perform a 2's complement operation on the frequency number contained in the frequency number latch 14 before it is transferred to the adder-accumulator 27. If $P_7$="0", then the 2's complement 30 will transfer the frequency number unaltered to the adder-accumulator 27.

While Q="1" the data select 21 selects the content of the adder-accumulator 27 to be transferred to the memory address decoder 24. While Q="0" the data select 21 selects the content of the adder-accumulator 27 to be transferred to the memory address decoder 24.

When the counter 28 reaches the count 2G, a signal is generated which resets the flip-flop 18. At this time the current segment of the waveshape memory 25 has been read back and forth for G times. An abrupt change is now made to read out the next waveshape segment in response to the accumulated frequency number contained in the adder-accumulator 15.

Figure 3:
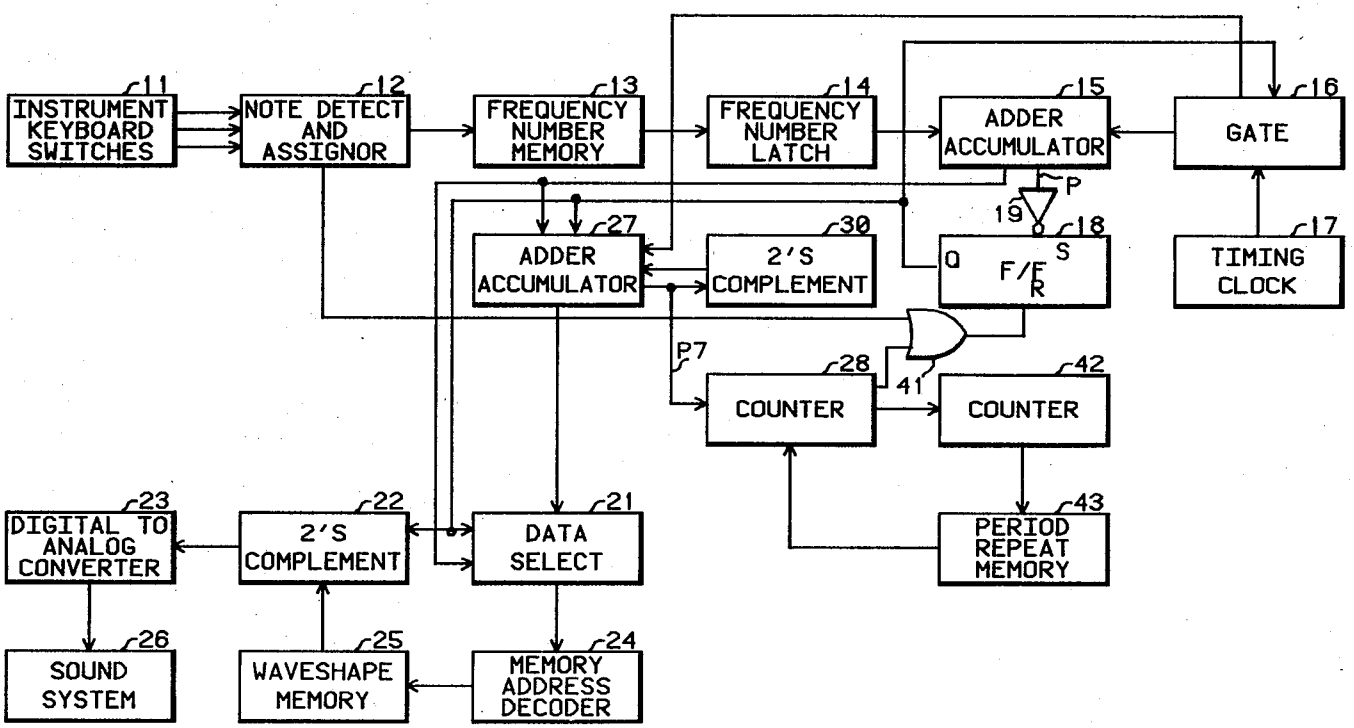
FIG. 3 is a schematic diagram of a variable repeat waveshape segment.

FIG. 3 illustrates a modification incorporated into the system shown in FIG. 2. The modification provides for a variable number of repeats so that each waveshape segment can be repeated a different number of preselected periods. This arrangement provides a further decrease in the number of waveshape data points that must be stored in the waveshape memory 25. During the transient phases of the musical tone generation, such as the attack, decay and release phases, each waveshape segment is repeated fewer times than during the almost constant sustain phase.

The counter 28 is implemented so that it counts modulo a number read into it from the period repeat memory 43. Each time that the counter 28 is reset because of its modulo counting implementation a signal is generated which increments the count state of the counter 42.

The period repeat memory 43 is an addressable memory storing values of the number of times each waveshape segment of the waveshape memory 25 is to be repeated. A repeat number is read out of the period repeat memory at an address corresponding to the state of the counter 42. The read and repeat number is transferred to the counter 28. The counter uses the input repeat number to determine the current modulo counting number.

I claim:

1. In combination with a keyboard operated musical instrument having an array of keyswitches, apparatus for producing a musical tone comprising;

an assignor means whereby a detect data word is generated in response to each actuated keyswitch in said array of keyswitches and one of a plurality of tone generators is assigned to each actuated keyswitch contained in said array of keyswitches and whereby a corresponding detect data word is provided to the corresponding said assigned tone generator, and said plurality of tone generators each of which comprises, a waveshape memory means for storing a plurality of data words stored in contiguous segments of data words.

a memory addressing means responsive to said provided detect data word whereby a selected segment of data words is read out from said waveshape memory means a preselected number of repetition timing periods before the readout is advanced to an adjacent segment of data words, whereby during each of of said timing periods the stored data words in said selected segment of data words is read out in a first order followed by reading out the same segment of data words in reverse order, a conversion means for producing a musical tone responsive to data words read out from said selected waveshape memory means.

2. In a musical instrument according to claim 1 wherein said assignor means comprises;

a keyswitch state detect means wherein a detect signal is generated in response to each actuated keyswitch in said array of keyswitches, and an encoding means for encoding each said detect signal to generate said corresponding data detect word which identifies each said actuated keyswitch corresponding to a generated detect signal.

3. In a musical instrument according to claim 2 wherein said assignor means further comprises;

a frequency number generating means whereby a frequency number is generated in response to each said detect data word, and assignor circuitry whereby said generated frequency number is transferred to an assigned one of said plurality of tone generators which corresponds to said detect data word.

4. In a musical instrument according to claim 3 wherein said memory addressing means comprises;

a timing clock for providing timing signals, an adder-accumulator means, comprising an accumulator, responsive to said timing signals for successively adding said generated frequency number to the content of said accumulator to produce an accumulated frequency number, and a reading means responsive to said generated frequency number and responsive to said accumulated frequency number whereby a selected segment of data words is read out from said waveshape memory means for said preselected number of timing repetition periods.

5. In a musical instrument according to claim 4 wherein said reading means comprises;

a first state detect means whereby a first state change signal is generated in response to a binary state change in a preselected bit position of said accumulated frequency number, a gate means interposed between said timing clock and said adder-accumulator means whereby in response to said first state change signal said timing signals are not transferred to said adder-accumulator means and whereby in response to a second state change signal said timing signals are transferred to said adder-accumulator means, a number memory means for storing said accumulated frequency number in response to said first state change signal, a subtract means responsive to said timing signals whereby said generated frequency number is successively subtracted from the accumulated frequency number contained in said number memory means to produce a modified accumulated frequency number, a second state detect means whereby said second state change signal is generated in response to a binary state change in said preselected bit position of said modified accumulated frequency number, a data select means whereby in response to said second state change signal said accumulated frequency number contained in said adder-accumulator means is selected and whereby in response to said first state change signal said modified accumulated frequency number in said number means is selected, and a waveshape reading means for reading out data words from said waveshape memory means in response to the outut from said data select means.

6. In a musical instrument according to claim 1 wherein each of said waveshape memory means stores a plurality of segments of data words and each said segment of data words corresponds to one half of the period of a waveshape having a symmetry about a midpoint having the number of data words as that contained in said segment of data words.

7. In a musical instrument according to claim 6 wherein said conversion means for producing a musical tone comprises;

a data conversion means for converting the data words read out from said waveshape memory means to produce said musical tone.

8. In a musical instrument according to claim 5 wherein said waveshape memory means stores a plurality of segments of data words and each said segment of data words corresponds to one half of the period of a waveshape having an odd symmetry about a midpoint having the number of data points as that contained in said segment of data words.

9. In a musical instrument according to claim 8 wherein said conversion means for producing a musical tone comprises;

a complementing means whereby a 2's complement binary operation is performed on the data words read out of said waveshape memory means in response to said first state change signal, and a data conversion means for converting the data words read out from said waveshape memory means to produce said musical tone.

10. In combination with a musical instrument, having an array of keyswitches, in which a musical tone is created by reading out stored waveshape data, apparatus for producing a musical tone comprising;

an assignor means for assigning one of a plurality of tone generators to an actuated one of said array of keyswitches, and said plurality of tone generators each of which comprises, a waveshape memory means for storing a plurality of segments of data words stored in contiguous segments of data words, a memory addressing means whereby successive segments of data words are read out from said waveshape memory means for a preselected number of repetitions before the read out is advanced to an adjacent segment of data words, a conversion means for producing a musical tone responsive to data words read out from said waveshape memory means.

* * * * *